US005170092A

United States Patent [19]

Tomii et al.

[11] Patent Number: 5,170,092

[45] Date of Patent: * Dec. 8, 1992

[54] ELECTRON-EMITTING DEVICE AND PROCESS FOR MAKING THE SAME

[75] Inventors: Kaoru Tomii, Isehara; Akira Kaneko, Tokyo; Toru Kanno, Kawasaki, all of Japan

[73] Assignee: Matsushita Electric Industrial Co., Ltd., Osaka, Japan

[ * ] Notice: The portion of the term of this patent subsequent to Oct. 1, 2008 has been disclaimed.

[21] Appl. No.: 524,117

[22] Filed: May 16, 1990

Related U.S. Application Data

[63] Continuation-in-part of Ser. No. 422,883, Oct. 17, 1989, Pat. No. 5,053,673.

[30] Foreign Application Priority Data

May 19, 1989 [JP] Japan ..... 1-126945
May 19, 1989 [JP] Japan ..... 1-126950

[51] Int. Cl.[5] ..... H01J 1/46

[52] U.S. Cl. ..... 313/310; 313/309; 313/311; 313/336

[58] Field of Search ..... 313/309, 310, 311, 336

[56] References Cited

U.S. PATENT DOCUMENTS 3,665,241 5/1972 Spindt et al. ..... 313/351
3,840,955 10/1974 Hagood et al. .
4,983,878 1/1991 Lee et al. ..... 313/336
5,053,673 10/1991 Tomii et al. ..... 313/336

FOREIGN PATENT DOCUMENTS 0364964 4/1990 European Pat. Off. .
54-17551 6/1979 Japan .
61-502151 9/1986 Japan .
85/05491 12/1985 World Int. Prop. O. .
88/01098 2/1988 World Int. Prop. O. .

OTHER PUBLICATIONS

"Novel Type of Emissive Flat Panel Display: The Matrixed Cold-Cathode Microtip Fluorescent Display", by G. Labrunie et al.; Displays, Jan. 1987, pp. 37-40.
"A Thin-Film Field-Emission Cathode", by P. A. Spindt; Journal of Applied Physics, vol. 39, pp. 3504 and 3505, Feb. 1968.
IBM Technical Disclosure Bulletin, vol. 32, No. 5b, Oct. 1989, pp. 239-240, New York, US; "Matrix Display Using Electron-Emission Devices".
Journal of Applied Physics, vol. 47, No. 12, Dec. 1976, pp. 5248-5263, New York, US; C. A. Spindt et al.: "Physical Properties of Thin-Film Field Emission Cathodes with Molybdenum Cones".

*Primary Examiner*—Donald J. Yusko
*Assistant Examiner*—N. D. Patel
*Attorney, Agent, or Firm*—Lowe, Price, LeBlanc & Becker

[57] ABSTRACT

An electron-emitting device including; electrical insulating substrates (1); an intermediate layer having a metal layer (2) and an insulating material layer (3) or having an insulating material layer (3), superposed in the thickness direction of said electrical insulating substrates (1) so as to be provided between said electrical insulating substrates (1) in the manner that it is recessed from one side surfaces of said electrical insulating substrates (1); a cathode material (4) provided at the middle portion of said intermediate layer, one end of said cathode material (4) protruding from the insulating material layer (3) that constitutes said intermediate layer; and a gate electrode (5) provided on said electrical insulating substrate (1) on the side where said intermediate layer is recessed.

7 Claims, 11 Drawing Sheets

ELECTRON-EMITTING DEVICE AND PROCESS FOR MAKING THE SAME

This application is a continuation-in-part of application Ser. No. 07/422,883, filed Oct. 17, 1989, now U.S. Pat. No. 5,053,673.

BACKGROUND OF THE INVENTION

1. Field of the Invention

This invention relates to an electron-emitting device (a cold cathode) and a process for making the same.

2. Description of the Prior Art

In order for electrons to be emitted, an electron cold cathode is comprised of a cathode emitter whose end is worked into a needle tip so as to have a curvature of 10 μm at its tip, and is so constituted that a strong electric field of about $10^6$ V/cm may be concentrated to the tip of this cathode emitter. Such an electron-emitting device commonly has a high current density and also does not require the heating of a cathode, and hence has the advantages that its power consumption can be very small and also it can be used as a point electron-ray source.

An electron-emitting device array is also conventionally known, which comprises a number of electron-emitting devices disposed in array. It has been also attempted to use such an electron-emitting device array in a flat panel display or the like (see Dispray, p. 37, Jan. 1987). A process for preparing a conventional electron-emitting device array will be described below with reference to the accompanying drawings.

As shown in FIG. 1, an electrical insulating substrate 101 is provided thereon with a conductive film 102, an insulating layer 103 and a conductive film 104 which are successively formed by vacuum deposition using suitable masks, and a plurality of cavities 105 disposed in array are produced. Subsequently, while a hole of each cavity 105 is gradually closed with a suitable material 107 by rotary oblique vacuum deposition, a cathode material 106 is regularly vacuum-deposited above the hole, so that a pyramidal, cathode emitter cone 108 is formed on the conductive film 102 in each cavity 105. Finally, the material 107 is removed as shown in FIG. 1B (Journal of Applied Physics, Vol. 39, p. 3504, 1968; etc.), Another example of a process for making a conventional electron-emitting device array will be described with reference to FIGS. 2A to 2F. As shown in FIG. 2A, a plural number of electrically insulating rectangular substrates 121 are prepared, and a cathode material thin film 122 is deposited on one surface of each substrate. A plural number of substrates 123 with cathode thin films are put together to be integrated, and then each surface of the substrates thus put together, i.e., joined or combined substrates 124, is mechanically polished. Next, as shown in FIG. 2B, a metal layer 125 is formed by vacuum deposition on one broad surface of the combined substrates, and, as shown in FIG. 2C, an aperture 126 having a width substantially equal to the thickness of the cathode material thin film 122, is made in the metal layer 125 by a lithography technique, at the position right above each cathode material thin film 122. The resulting product is then separated into each substrate 123 with a cathode material thin film, and, as shown in FIG. 2D, the cathode material thin film 122 on each substrate 123 is worked by etching so as to have tips with a pattern of sharp crests. In all the substrates

123 thus obtained, the substrate 121 is partly removed by appropriate chemical corrosion to the extent that the vicinity of the tips of the cathode emitter 127 of each substrate becomes separate from the substrate 121 as shown in FIG. 2E and also the metal layer 125 with the aperture 126 projects from the substrate 121 in the form of a shelf. A cavity 128 is thus formed in each substrate 123. Then, as shown in FIG. 2F, the substrates 123 are again put together and fixed so as to be in the same state as the combined substrates 124 having been not separated. A thin-film cold cathode array can be thus obtained. (Japanese Patent Publication No. 54-17551).

However, in the process for making the former of the above conventional techniques, the rotary oblique vacuum deposition and the rotary vacuum deposition carried out from right above the hole are simultaneously performed when the cathode emitter cone 108 is formed in the cavity 105, and it is very difficult to accurately control the simultaneous vacuum deposition.

On the other hand, in the process for making the latter, an attempt to enhance the accuracy of alignment of the aperture 126 and the cathode material thin film 122 requires a high accuracy in the sheet thickness of the insulating substrate 121 and the film thickness of the cathode material thin film 122. In addition, the accuracy for integrating and fixing substrates must be identical before and after the combined substrates 124 are separated, and it is very difficult to fix them in a good accuracy.

SUMMARY OF THE INVENTION

The present invention solves the problems involved in the prior art as described above.

An object of the present invention is to provide an electron-emitting device that can readily concentrate electric fields, can improve electron emission efficiency, and also can increase the pressure resistance of a cathode and a gate electrode and can improve the reliability thereof.

Another object of the present invention is to provide a manufacturing process by which an electron-emitting device having achieved accurate alignment of a cathode and a gate electrode can be manufactured with ease in a good yield.

The above objects can be achieved by the electron-emitting device of the present invention, which is an electron-emitting device comprising;

electrical insulating substrates;

an intermediate layer comprising a metal layer and an insulating material layer or comprising an insulating material layer, superposed in the thickness direction of said electrical insulating substrates so as to be provided between said electrical insulating substrates in the manner that it is recessed from one side surfaces of said electrical insulating substrates;

a cathode material provided at the middle portion of said intermediate layer; one end of said cathode material protruding from the insulating material layer that constitutes said intermediate layer; and a gate electrode provided on said electrical insulating substrate on the side where said intermediate layer is recessed.

The above objects can also be achieved by the process for manufacturing an electron-emitting device according to the present invention, which is a process comprising the steps of;

forming a cathode material at the middle portion of an intermediate layer comprising a metal layer or an insulating material layer so as to be provided between electrical insulating substrates in the manner that said cathode material and said metal layer or insulating material layer are uncovered to at least one surface;

forming a mask on the uncovered portions of said cathode material and metal layer or insulating material layer;

providing a conductive film on said mask and said electrical insulating substrates;

removing said mask together with said conductive film provided on said mask to form an aperture over the uncovered portion of said cathode material, and to leave on the surface of each electrical insulating substrate a conductive film serving as a gate electrode; and removing said metal layer or insulating material layer in a given quantity at the part surrounding said cathode material, on the side at which said aperture is formed. In the instance where the intermediate layer comprises a metal layer, the metal layer is partly subjected to insulation treatment on the side at which it has been removed.

The above electrical insulating substrates are firmly joined in layers by any of a melt-adhesion process, an adhesion process using a low-melting frit glass and an adhesion process using a heat-resistant adhesive. In order to form the above mask with ease, the mask may be formed by depositing a metal by electroplating on the uncovered surface of the above cathode material and the above intermediate layer comprising a metal layer or an insulating material layer. Alternatively, the above electrical insulating substrate may be comprised of a light-transmissive material, and a positive type photoresist is coated on one side surfaces of the above electrical insulating substrates, the intermediate layer comprising a metal layer or an insulating material layer and the cathode material, which is then exposed to light from the other side surfaces of the above electrical insulating substrates, followed by development. The mask can be thus formed on the uncovered portions of the cathode material and the metal layer or insulating material layer. The above metal layer can be partly subjected to insulation treatment by a conventional anodizing process.

The cathode material is formed between the electrical insulating substrates to have a wall thickness of from about 100 Å to about 1 μm. The conductive film serving as the gate electrode is formed of a material having a corrosion resistance to an etchant used for removing the mask and for etching away the metal layer or insulating material layer at the periphery of the cathode material. The metal layer surrounding the cathode material is formed using any of Al and Ta so that it can be insulation-treated by anodizing. The cathode material is made to comprise any of W, Mo, TiC, SiC ZrC and $LaB_6$, which are materials having a high melting point and a low work function.

BRIEF DESCRIPTION OF THE DRAWINGS

FIGS. 3 to 7 show an electron-emitting device according to a first embodiment of the present invention, in which;

FIG. 3 is a schematic cross-section to illustrate a structure of the electron-emitting device;

FIGS. 4A to 4E are schematic perspective views to illustrate steps for the manufacture, and FIGS. 4F to 4K are schematic cross sections of the manufacturing steps, along the line I—I in FIG. 4E;

FIG. 7 is a schematic perspective view to illustrate an example in which an electron-emitting device array obtained by the present invention is utilized.

FIG. 8 to 11 show an electron-emitting device according to a second embodiment of the present invention, in which;

FIG. 8 is a schematic cross section to illustrate a structure of the electron-emitting device;

FIGS. 9A to 9F are schematic perspective views to illustrate steps for the manufacture, and FIGS. 9G to 9K are schematic cross sections of the manufacturing steps, along the line II—II in FIG. 9F;

FIG. 10A is a plan view to illustrate a one-dimensional array portion, FIG. 10B is a plan view of the array from which a gate electrode has been removed, FIG. 10C is a cross section along the line III—III in FIG. 10A; FIG. 11A is a plan view to illustrate a one-dimensional array portion, FIG. 11B is a plan view of the array from which a gate electrode has been removed, and FIG. 11C is a cross section along the line IV—IV in FIG. 11A.

DESCRIPTION OF THE PREFERRED EMBODIMENT

A first embodiment of the present invention will be described below with reference to FIGS. 3 to 7.

An electron-emitting device will first be described.

Figure 1A:
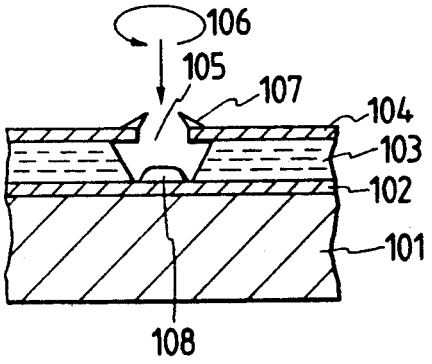
FIG. 1A PRIOR ART
FIGS. 1A and 1B and FIGS. 2A to 2F each illustrate a process for manufacturing a prior art electron-emitting device array.
Figure 1B:
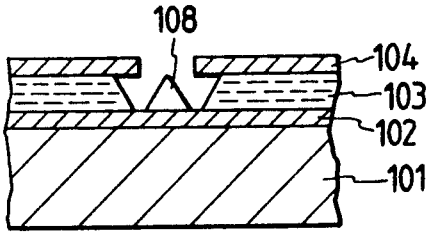
FIG. 1B PRIOR ART
Figure 2A:
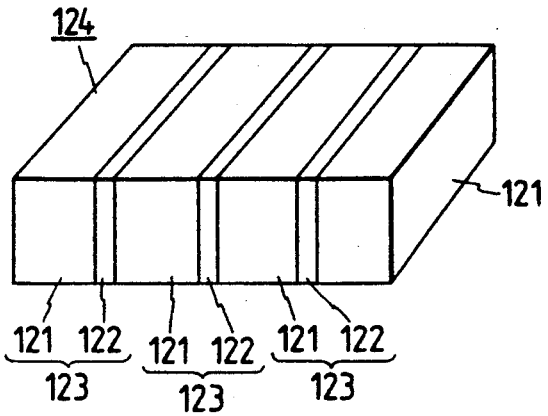
FIG. 2A PRIOR ART
Figure 2B:
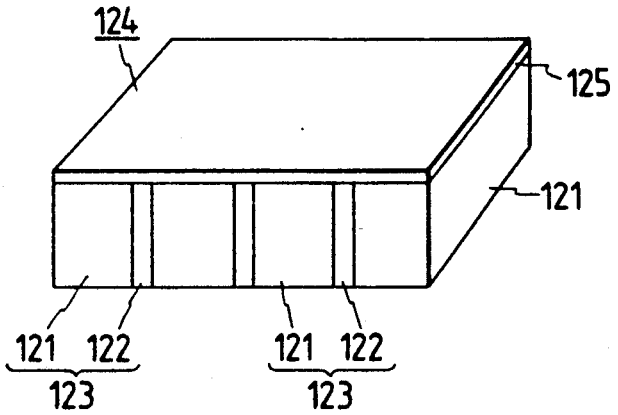
FIG. 2B PRIOR ART
Figure 2C:
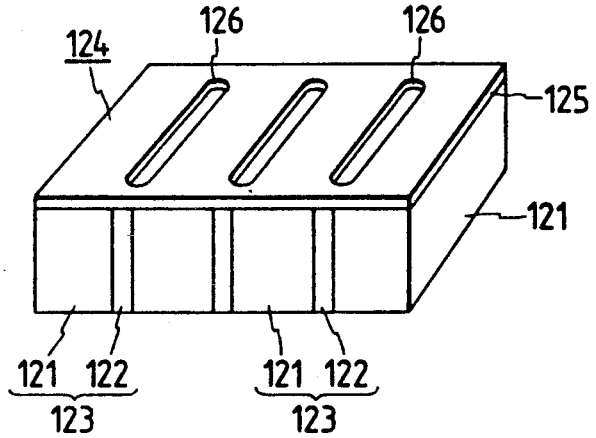
FIG. 2C PRIOR ART
Figure 2D:
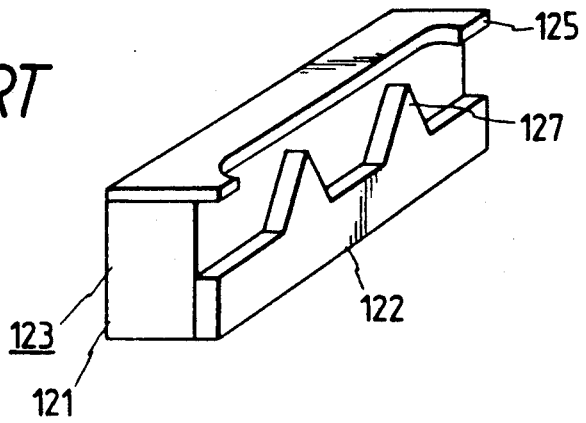
FIG. 2D PRIOR ART
Figure 2E:
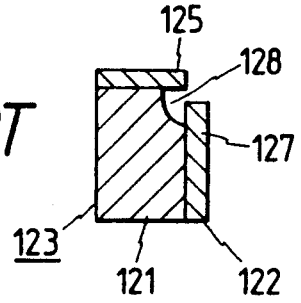
FIG. 2E PRIOR ART
Figure 2F:
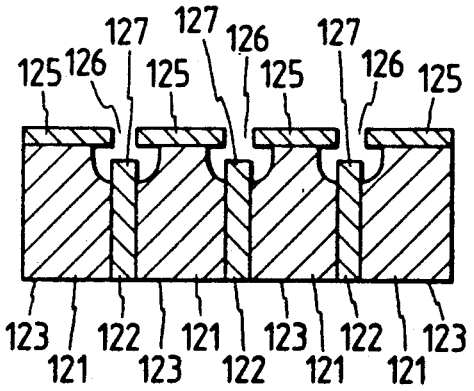
FIG. 2F PRIOR ART
Figure 3:
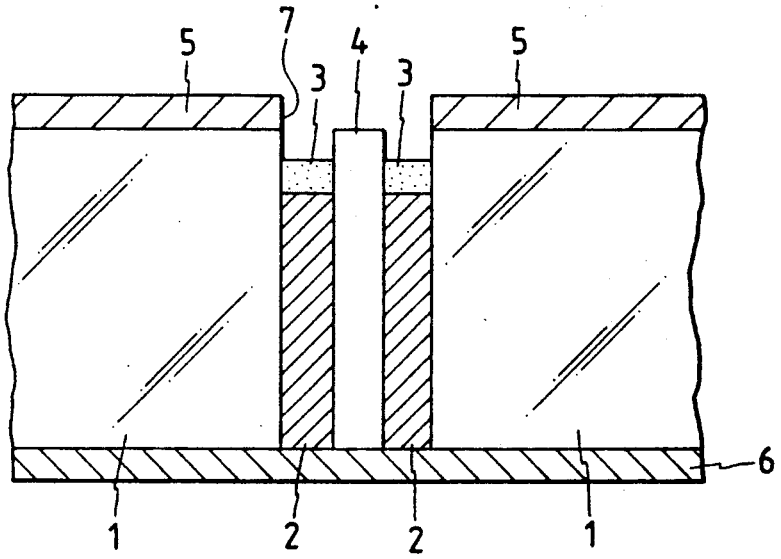

FIG. 3 is a schematic cross-section to illustrate an electron-emitting device according to the first embodiment of the present invention. As shown in FIG. 3, an intermediate layer comprising a metal layer 2 comprised of Al, Ta or the like and an insulating material layer 3 comprised of $Al_2O_3$ or the like is superposed in the thickness direction of electrical insulating substrates 1 so as to be provided between the electrical insulating substrates 1 comprised of glass, ceramics or the like. The insulating material layer 3 is recessed from one side surfaces of the electrical insulating substrates 1. At the middle portion of the intermediate layer comprising the metal layer 2 and the insulating material layer 3, a cathode material 4 comprised of W, Mo, TiC, SiC, ZrC, $LaB_6$ or the like is provided, and is so formed that one end thereof protrudes from the insulating material layer 3 and its protruding end surface is on substantially the same level as the one side surfaces of the electrical insulating substrates 1. The cathode material 4 is formed between the electrical insulating substrates 1 to have a wall thickness of from about 100 Å to about 1 μm. A gate electrode 5 comprised of W, Mo or the like is provided on the electrical insulating substrate on the side where the insulating material layer 3 is recessed. In the case when an electron-emitting device array is prepared, a conductive layer 6 electrically connected with the cathode material 4 is optionally provided on the reverse side of the electrical insulating substrate 1 on which the gate electrode is provided.

According to the above embodiment, it is possible to make very small the size of the tip of the cathode material 4 so that an electric field can be readily concentrated, and hence electrons can be drawn out through an aperture 7 in a good efficiency even when a low voltage is applied between it and the gate electrode 5. In order to increase the pressure resistance of the cathode material 4 and the gate electrode 5, a space gap and the insulating material layer 3 is provided between them, and hence the reliability can be improved.

A process for manufacturing the electron-emitting device will be described below.

Figure 4D:
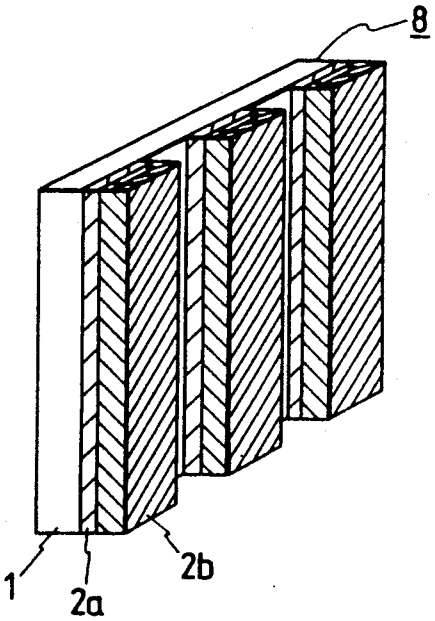
FIGS. 4A to 4K illustrate a process for manufacturing the electron-emitting device, where
Figure 4C:
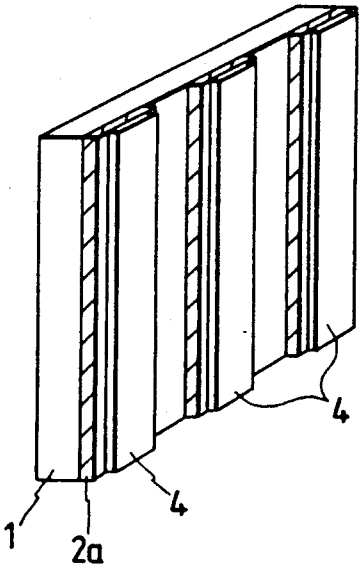
Figure 4B:
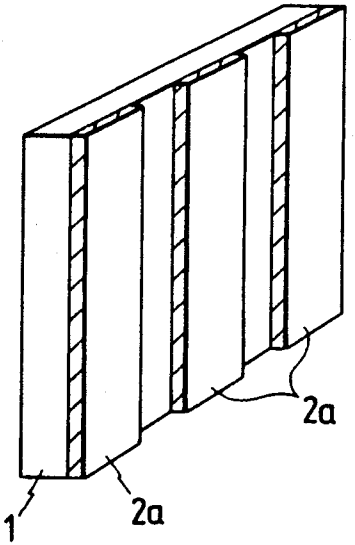
Figure 4A:
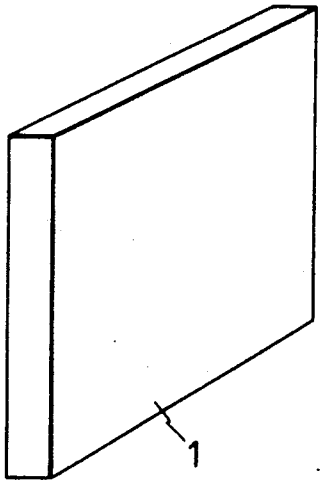
Figure 4E:
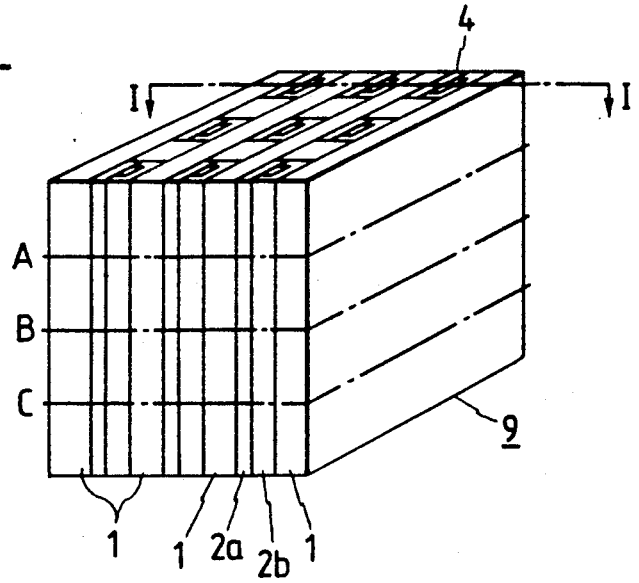

FIGS. 4A to 4K illustrate a process for manufacturing the electron-emitting device according to the first embodiment of the present invention, where FIGS. 4A to 4E are schematic perspective views to illustrate steps for the manufacture, and FIGS. 4F to 4K are schematic cross sections of the manufacturing steps, along the line I—I in FIG. 4E. FIGS. 5A to 5D are schematic plan views of FIGS. 4A to 4B.

Figure 5D:
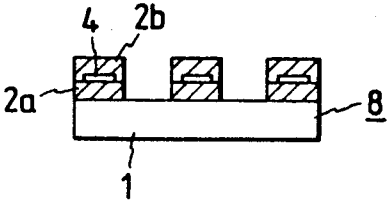
FIGS. 5A to 5D are schematic plan views of FIGS. 4A to 4B.
Figure 5B:
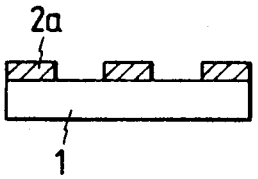
Figure 5A:
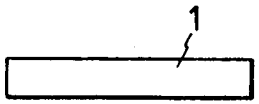
Figure 6A:
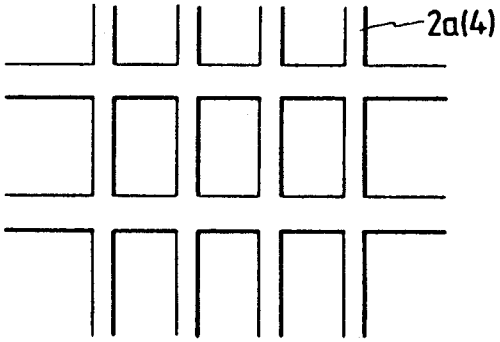
FIG. 6A and 6B are each a partial front view to illustrate another example of the pattern of a metal layer.
Figure 6B:
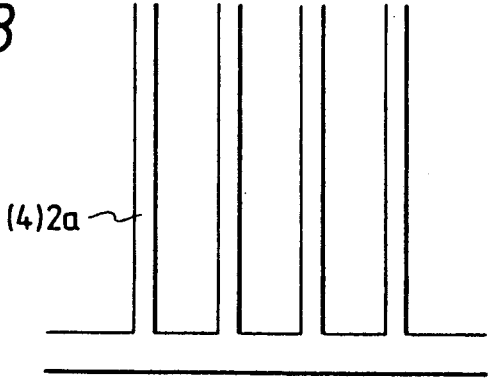

In the present embodiment, a process of manufacturing an electron-emitting device array will be described. As shown in FIGS. 4A and 5A, an electrical insulating substrate 1 made of an insulating material such as glass or alumina and whose surface has been polished to a sufficient smoothness is prepared. As shown in FIGS. 4B and 5B, a first metal layer 2*a* comprised of Al, Ta of the like capable of being readily subject to insulation treatment is formed on one side surface of the electrical insulating substrate 1 to have a given thickness (for example, 0.5 to 1 μm) with a stripe pattern. The stripe pattern of the first metal layer 2*a* is formed by masked vacuum deposition, or formed on the whole surfaces of the electrical insulating substrate 1 by sputtering or like, followed by a lithography technique. The pattern of the first metal layer 2*a* may not be limited to the stripe as mantioned above, and any desired patterns of the form of a lattice as shown in FIG. 6A or the form of a comb as shown in FIG. 6B can be selected depending on uses.

Figure 5C:
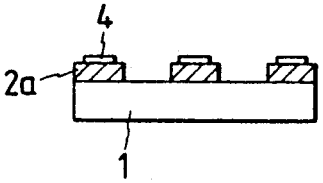

Next, as shown in FIGS. 4C and 5C, a cathode material 4 comprised of W, Mo, TiC, SiC, ZrC, $LaB_6$ or the like formed on each first metal layer 2*a* by masked vacuum deposition, CVD or the like to have a given thickness (100 Å to 1 μm). Each cathode material 4 is so formed as to have the same width as, or narrower width than, that of the first metal layer 2*a*.

Next, as shown in FIGS. 4D and 5D, a second metal layer 2*b* comprised of the same material as that of the above first metal layer 2*a* is formed on each cathode material 4 by masked vacuum deposition so as to have the same thickness as that of the first metal layer 2*a*.

A composite substrate 8 with the constitution as described above is prepared in plural number, and the resulting composite substrate 8 and an electrical insulating substrate 1 on which the cathode material 4 and so forth are not provided are put together in such a manner that, as shown in FIG. 4E, the metal layers 2*a* and 2*b* and the cathode material 4 are held between the electrical insulating substrates 1 to form an integrated body. A joined or combined body 9 is thus formed. In making this combined body, a firmly combined body can be obtained by making integration by a melt-adhesion process or an adhesion process using a low-melting frit glass or using a heat-resistant adhesive, so that an array substrate 10 as described below can be made tough.

Figure 4F:
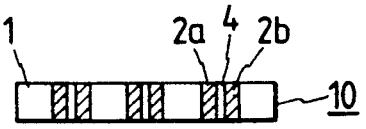

Next, as shown in FIG. 4E, the combined body 9 is cut along the chain lines A, B and C across the longitudinal direction of the cathode material 4. Then, each cut surface is mechanically polished to obtain an array substrate 10 as shown in FIG. 4F. To both the surfaces of this array substrate 10, the cathode materials 4 are uncovered in the state that they are surrounded by or sandwiched between the metal layers 2*a* and 2*b* and separated in array (thus forming an array cathode pattern).

Figure 4G:
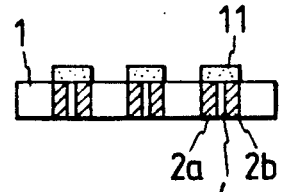

Subsequently, as shown in FIG. 4G, a mask 11 comprising a metal layer with a given thickness is selectively formed by conventional electroplating on the uncovered surfaces of the cathode materials 4 and the metal layers 2*a* and 2*b*. In the case when the electrical insulating substrate 1 is comprised of a light-transmissive material, the mask 11 may alternatively be a mask formed of a photoresist, which is obtained by forming a positive type photoresist layer with a uniform film thickness on one side surface of the array substrate 10, and exposing the photoresist layer to ultraviolet rays from the other surface side of the array substrate 10, followed by development.

Figure 4H:
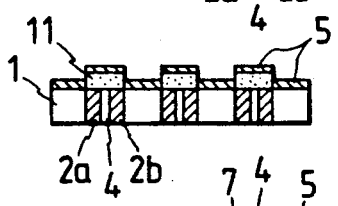
Figure 4I:
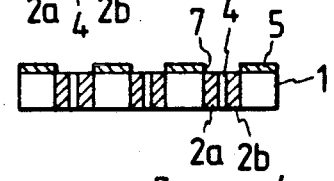

After formation of the mask 11, as shown in FIG. 4H a conductive film comprised of W, Mo or the like for the formation of the gate electrode 5 is formed on the mask by vacuum deposition or the like. Then, the mask 11 is etched away using a suitable solvent so that the conductive fim on the mask 11 is also removed together as shown in FIG. 4I. Thus each aperture 7 is formed and at the same time the gate electrode 5 can be left on the surface of the array substrate 10. Here, the gate electrode 5 may alternatively be electrically divided between the groups of array to give a plurality of independent modulating electrodes.

Figure 4J:
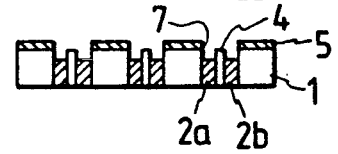

Next, as shown in FIG. 4J, the metal layers 2*a* and 2*b* facing the aperture 7 and surrounding each cathode material 4 are removed by chemical etching or the like to a given depth, for example, of from 100 Å to 5 μm so that each cathode material 203 may projected with a given length. Materials must be selected so as not for the gate electrode 5 and the cathode material 4 to be corroded by this etching.

Figure 4K:
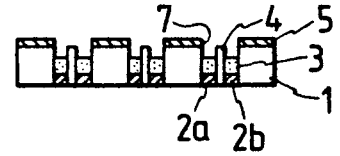

Next, as shown in FIG. 4K, insulation treatment is applied using Al or Ta to the etched side of the metal layers 2*a* and 2*b* to form an insulating material layer 3*a* with a given thickness. Use of Al or Ta for the metal layers 2*a* and 2*b* as mentioned above enables treatment for converting the metal layer into insulating material by a conventional anodizing process. When the cathode materials 4 laterally arranged are optionally connected to one, a conductive layer (6, in FIG. 3) may be formed on the surface of the array substrate 10, opposite to the side on which the gate electrode 5 is formed.

Figure 7:
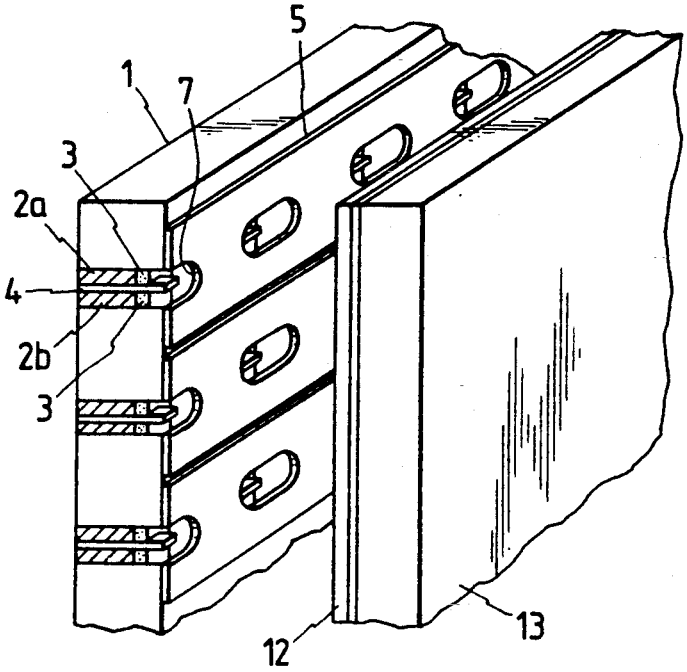

The electron-emitting device array thus obtained can be joined, as shown in FIG. 7, to a transparent insulating substrate 13 provided with a luminescent layer 12 on the back so that it can be used as a flat panel display.

Thus, according to the above embodiment, the combined body 9 may only be cut across the pattern of the cathode materials 4, whereby the array substrate 10 on which the cathode materials 4 are uncovered in the manner that they are distributed in array can be obtained. In addition, the aperture 7 or the gate electrode 5 can be formed by removing the conductive film formed thereon, together with the removal of the mask 11 previously selectively formed on the uncovered surface of each cathode material 4. Hence the conventional simultaneous controlling of the oblique vacuum deposition and regular vacuum deposition becomes unnecessary, and moreover the aperture 7 and the cathode material 4 can be readily aligned in a good accuracy.

The present invention is by no means limited to the above embodiment.

In the above embodiment, the first metal layer 2*a* is formed with a given pattern. Alternatively, a first metal layer may be formed over the whole surface of the electrical insulating substrate 1, where a cathode material 4 with a given pattern is formed on the first metal layer 2*a* thus formed, and then a second metal layer 2*b* is formed over the whole surface. In the above embodiments, two-dimensional arrays are described, but one-dimensional array may also be available. In such an instance, a device is used in which one layer of a cathode material layer only is held between two sheets of substrates. More specifically, an electrical insulating substrate 1 provided with a pattern of a cathode material 4 and a electrical insulating substrate 1 provided with no pattern of the cathode material are adhered sheet by sheet to make a combined body, or two sheets of electrical insulating substrates provided with patterns of cathode materials 4 are adhered in such a way that the surfaces on which the patterns are formed face each other, to make a combined body. Alternatively, a two-dimensional array may be prepared by first preparing a plurality of one-dementional arrays, and assembling them. The gate electrode array may be limited to be used as the flat panel display, and can also be used in printers and so fourth. In addition, the electron-emitting device may not be limited to be in the form of an array, and may be used alone as it is.

The electron-emitting device of the present invention can operate, for example, as follows.

In the device as shown in FIG. 3, a voltage applied in vacuum to the cathode material 4, which is electrically connected through the conductive layer 6, and the gate electrode 5 so as for the gate electrode 5 to be the positive side. This voltage may be applied at about $10^6$ V/cm, so that electrons are drawn out of the cathode material 4. Then, pulse signals corresponding to horizontal scanning lines are applied to the respective gate electrodes 5 provided, as shown in FIG. 7, in an electrically divided form in the direction perpendicular to a screen, so that the electrons thus drawn out are converted to electron beams emitted in the direction perpendicular to the screen. Modulated signals such as image signals are also applied to the cathode material 4, and the electrons modulated and having passed the opening (the aperture 7) of the gate electrode 5 make luminous a luminescent layer 12 comprising a phosphor, provided on the inner surface on the vacuum side of a transparent insulating substrate 13.

A second embodiment of the present invention will be described below with reference to FIGS. 8 to 11.

An electron-emitting device will first be described.

Figure 8:
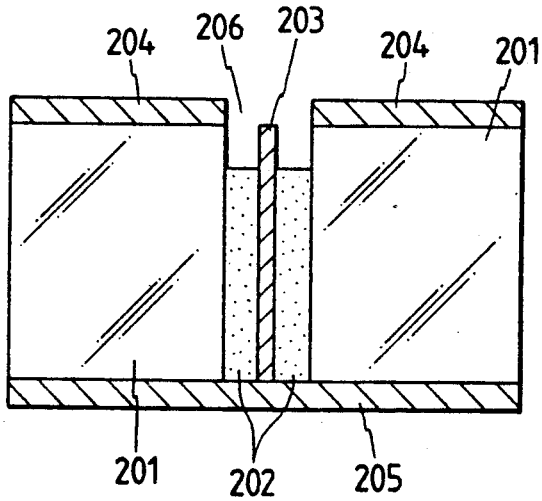

FIG. 8 is a schematic cross-section to illustrate an electron-emitting device. As shown in FIG. 8, an insulating material layer 202 as an intermediate layer comprised of $A1_2O_3$, $SiO_2$, $Si_3N_4$ or the like is provided between electrical insulating substrates 201 comprised of glass, ceramics or the like. The insulating material layer 202 is recessed from one side surfaces of the electrical insulating substrates 201. At the middle portion of the insulating material layer 202, a cathode material 203 comprised of W, Mo, Ta, TiC, SiC, ZrC, $LaB_6$ or the like is provided, and is so formed that one end thereof protrudes in a given quantity from the recessed side of the insulating material layer 202 and its protruding end surface is on substantially the same level as the one side surfaces of the electrical insulating substrates 201. The cathode material 203 is formed between the electrical insulating substrates 201 to have a wall thickness of from about 100 Å to about 2 μm. A gate electrode 204 comprised of W, Mo, Ta or the like is provided on the electrical insulating substrate 201 on the side where the insulating material layer 202 is recessed. In the case when an electron-emitting device array is prepared, a conductive layer 205 electrically connected with the cathode material 203 is optionally provided on the reverse side of the electrical insulating substrate 201 on which the gate electrode is provided.

According to the above embodiment, it is possible to determine the shape of the tip of the cathode material 203 only on the basis of the film thickness, and to make very small the size thereof so that an electric field can be readily concentrated, and hence electrons can be drawn out through an aperture 206 in a good efficiency even when a low voltage is applied between it and the gate electrode 204. In order to increase the pressure resistance of the cathode material 203 and the gate electrode 204, a space gap and the insulating material layer 203 is provided between them, and hence the reliability can be improved.

A process for manufacturing the electron-emitting device will be described below.

Figure 9A:
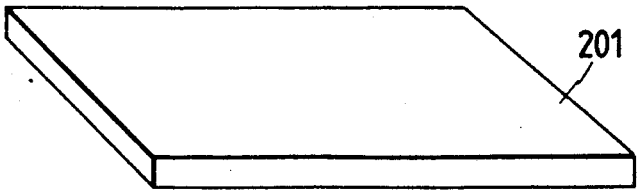
FIGS. 9A to 9K illustrate a process for manufacturing the electron-emitting device, where
Figure 9B:
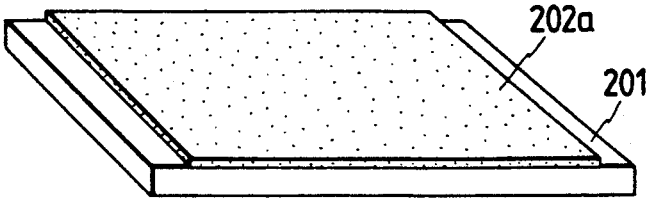
Figure 9C:
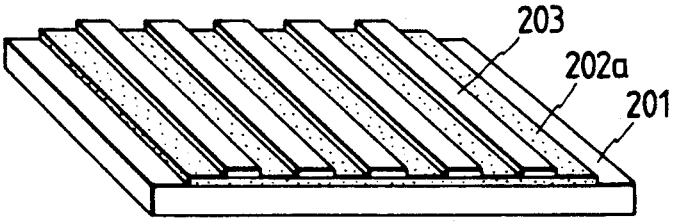
Figure 9D:
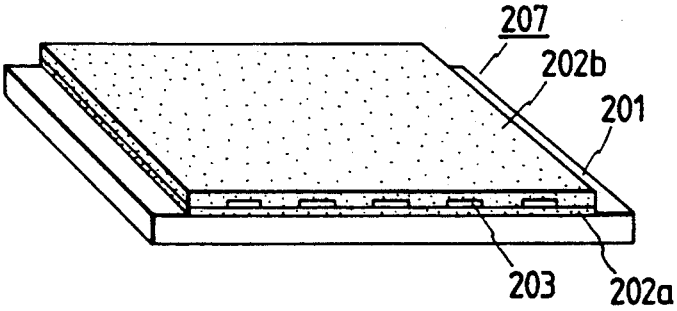
Figure 9E:
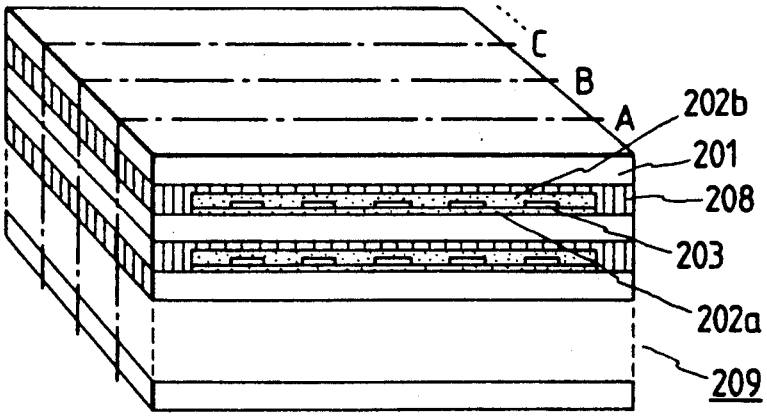

FIGS. 9A to 9K illustrate a process for manufacturing the electron-emitting device according to the second embodiment of the present invention, where FIGS. 9A to 9F are schematic perspective views to illustrate steps for the manufacture, and FIGS. 9G to 9K are schematic cross sections of the manufacturing steps, along the line II—II in FIG. 9E.

In the present embodiment, a process of manufacturing an electron-emitting device array will be described. As shown in FIGS. 9A, an electrical insulating substrate 201 made of an insulating material made of ceramics, glass, alumina or the like and whose surface has been polished to a sufficient smoothness is prepared. As shown in FIGS. 9B, a first insulating material layer 202*a* comprised of $Al_2O_3$, $SiO_2$, $Si_3N_4$ or the like is formed on substantially the whole of one side surface of the electrical insulating substrate 201 by sputtering, CVD or the like to have a given thickness (for example, 0.5 to 5 μm) with a stripe pattern.

Next, as shown in FIGS. 9C, a cathode material 203 comprised of W, Mo, Ta, TiC, SiC, ZrC, $LaB_6$ or the like is formed in stripes on the first insulating material layer 202*a* by sputtering, CVD or the like to have a given thickness (100 Å to 2 μm). The pattern of the cathode material 203 may not be limited to the stripe as mentioned above, and any desired patterns and size such as the form of a lattice or the form of a comb can be selected depending on uses. These patterns can be formed by masked vacuum deposition, or formed on the whole surface of the first electrical insulating substrate 201 by vacuum deposition, sputtering or like, followed by a lithography technique.

Next, as shown in FIG. 9D, a second insulating material layer 202*b* comprised of the same material as that of the above first insulating material layer 202*a* is formed on the cathode material 203 by sputtering, CVD or the like. This second insulating material layer 202*b* is formed to have the same dimensions as the above first insulating material layer 202b and have a thickness of from about 0.5 to about 5 μm.

A composite substrate 207 with the constitution as described above is prepared in plural number, and the resulting composite substrate 207 and an electrical insulating substrate 201 on which the cathode material 203 and so forth are not provided are put together in such a manner that, as shown in FIG. 9E, the insulating material layer 202a and 202b and the cathode material 203 is held between the electrical insulating substrates 201. Then a firmly integrated combined body is formed through an adhesion joint 208 by a melt-adhesion process or an adhesion process using a low-melting frit glass, or using a heat-resistant adhesive. The adhesion joint 208 can be set at various positions depending on uses.

Figure 9F:
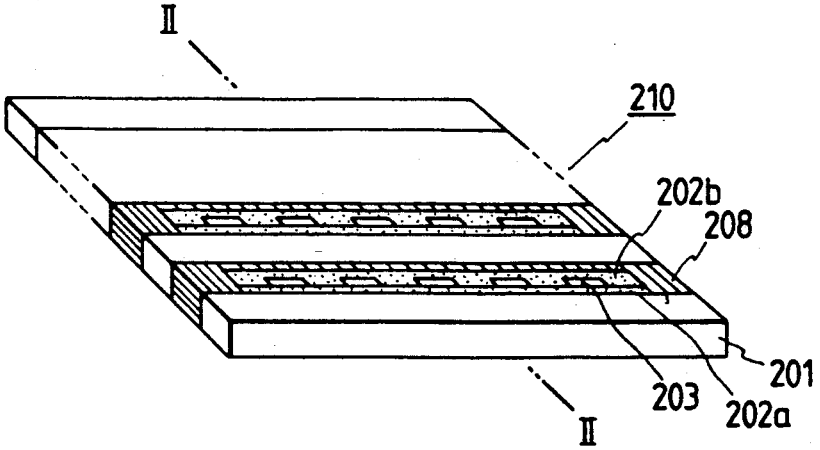

Next, as shown in FIG. 9E, the combined body 209 is cut along the chain lines A, B and C across the longitudinal direction of the cathode material 203. Then, each cut surface is mechanically polished to obtain an array substrate 210 as shown in FIG. 9F. To both the surfaces of this substrate 210, the cathode materials 203 are uncovered in the state that they are surrounded by or sandwiched between the insulating material layers 202a and 202b and separated in array (thus forming an array cathode pattern).

Figure 9G:
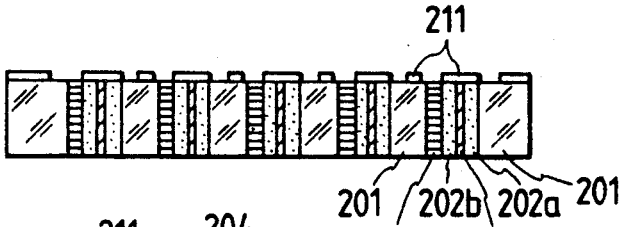

Subsequently, as shown in FIG. 9G, a mask 211 comprising a metal layer with a given thickness is selectively formed by conventional electroplating on each of the cathode materials 203, the uncovered surfaces of the one side of the insulating material layers 202a and 202b, and the surfaces of the electrical insulating substrates 201, except for their longitudinal margins along the insulating material layers 202a and 202b. In the case when the electrical insulating substrate 201 is comprised of a light-transmissive material, the mask 211 may alternatively be a mask formed of a photoresist, which is obtained by forming a positive type photoresist layer with a uniform film thickness on one sude surface of the array substrate 210, and exposing the photoresist layer 1 to ultraviolet rays from the other surface side of the array substrate 210, followed by development.

Figure 9H:
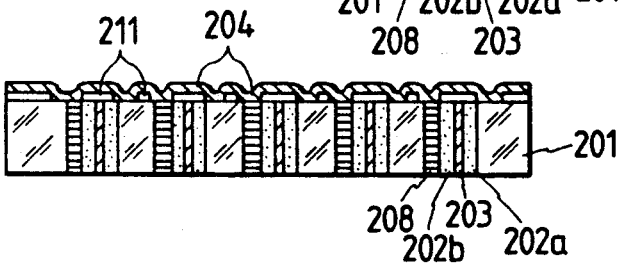
Figure 9I:
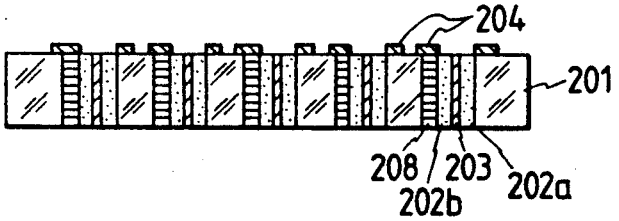

After formation of the mask 211, as shown in FIG. 9H, a conductive film comprised of W, Mo, Ta or the like for the formation of the gate electrode 204 is formed on the mask by a process such as vacuum deposition, sputtering or CVD. Then, the mask 211 is etched away using a suitable solvent so that the conductive film on the mask 211 is also removed together as shown in FIG. 9I. Thus, each aperture 206 is formed and at the same time the gate electrode 204 can be left on the surface of the array substrate 210.

Figure 9J:
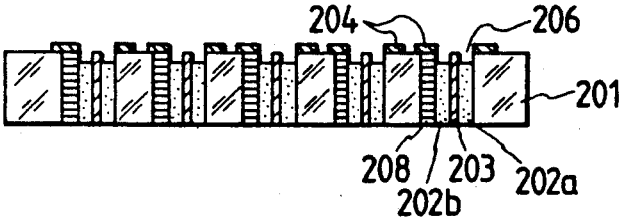

Next, as shown in FIG. 9J, the insulating material layers 202a and 202b facing the aperture 206 and surrounding each cathode material 203 are removed by chemical etching or the like to a given depth, for example, of from 100 Å to 5 μm so that each cathode material 203 may be projected with a given length. Materials must be selected so as not for the gate electrode 204 and the cathode material 203 to be corroded by this etching. When, for example, the insulating material layers 202a and 202b are comprised of $Al_2O_3$ or $Si_3N_4$, hot phosphoric acid is suited as a material for the etchant. When the insulating material layers 202a and 202b comprised of $SiO_2$, hydrofluoric acid or the like is suited as a material for the etchant. In such an instance, W and Mo are suited as materials for the gate electrode 204 and the cathode material 203.

Figure 9K:
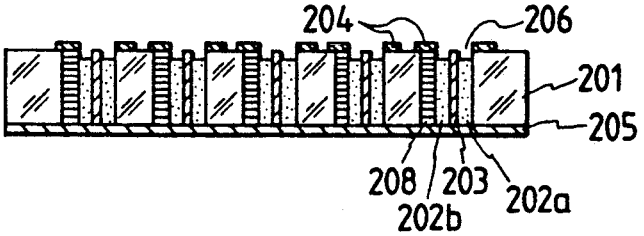

When the cathode materials 203 laterally arranged are optionally connected to one, a conductive layer 205 may be formed, as shown in FIG. 9K, on the surface of the array substrate 210, opposite to the side on which the gate electrode 204 is formed.

The electron-emitting device array thus obtained can be joined to a transpatent insulating substrate provided with a luminescent layer on the back so that it can be used as a flat panel display.

Thus, according to the above embodiment, the combined body 209 may cut across the pattern of the cathode materials 203, whereby the array substrate 210 on which the cathode materials 203 are uncovered in the manner that they are distributed in array can be obtained.

In addition, the aperture 206 or the gate electrode 204 can be formed by removing the conductive film formed thereon, together with the removal of the mask 211 previously selectively formed on the uncovered surface of each cathode material 203. Hence, the conventional simultaneous controlling of the oblique vacuum deposition and regular vacuum deposition becomes unnecessary, and moreover the aperture 206 and the cathode material 203 can be readily aligned in a good accuracy. Another embodiment of the manufacturing process of the present invention will be described below.

Figure 10A:
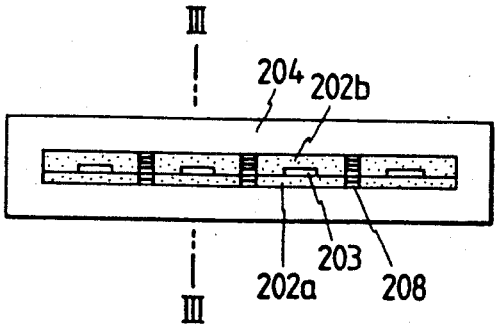
FIGS. 10A to 10C show another manufacturing process in the second embodiment, where
Figure 10C:
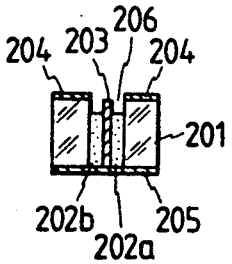
Figure 10B:
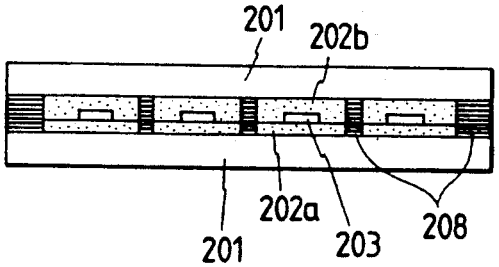

FIGS. 10A to 10C show a process for manufacturing an elecrtron-emitting device. FIG. 10A is a plan view to illustrate a one-demensional array portion, FIG. 10B is a plan view of the array from which a gate electrode has been removed, and FIG. 10C is a cross section along the line III—III in FIG. 10A.

In the present embodiment, as shown in FIG. 10A to 10C, first and second insulating material layers 202a and 202b and a cathode material 203 are formed into a pattern of wide stripes, and adhesion joints 208 are provided between the stripes. A combined body 209 (see FIG. 9E) is thus formed.

Still another embodiment of the present invention will be described below.

Figure 11A:
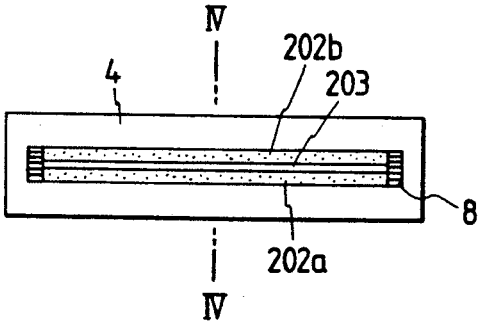
FIGS. 11A to 11C show another manufacturing process in the second embodiment, where
Figure 11C:
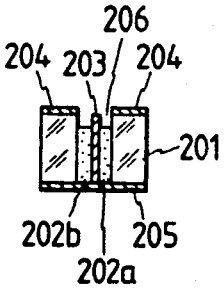
Figure 11B:
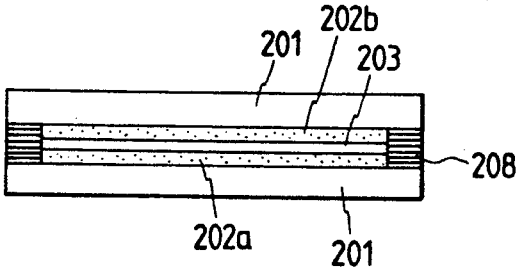

FIGS. 11A to 11C show a process for manufacturing an electron-emitting device. FIG. 11A is a plan view to illustrate a one-dimensional array portion, FIG. 11B is a plan view of the array from which a gate electrode has been removed, and FIG. 11C is a cross section along the line IV—IV in FIG. 11A.

In the present embodiment, as shown in FIG. 11A to 11C a cathode material 203, which has a dot-like form in FIG. 10A, is replaced with a cathode material having a linear form. Other components are the same as those in the above embodiment.

In the present invention according to the above embodiments, the debice may not be limited to the two-dimensional arrays as described, and one-dimensional array may also be available. In such an instance, a device is used in which one layer of a cathode material layer only is held between two sheets of substrates. More specifically, an electrical insulating substrate 201 provided with a pattern of a cathode material 203 and a electrical insulating substrate 201 provided with no pattern of the cathode material are adhered sheet by sheet to make a combined body, of two sheets of electrical insulating substrates provided with patterns of cathode materials 203 are adhered in such a way that the surfaces on which the patterns are formed face each other, to make a combined body. Alternatively, a two-dimensional array may be prepared by first preparing a plurality of one-dimentional arrays, and assembling them. The gate electrode array may not be limited to be used as the flat panel display, and can also be used in printers and so fourth. In addition, the electron-emitting device may not be limited to be in the form of an array, and may be used alone as it is.

As described above, according to the electron-emitting device of the present invention, it is possible to determine the shape of the tip of the cathode material only on the basis of the film thickness, and to make very small the size thereof so that an electric field can be readily concentrated, and hence electrons can be drawn out in an improved efficiency. It is also possible to increase the pressure resistance of the cathode material and the gate electrode because a space gap is formed between the cathode material and the gate electrode and the metal layer and the insulating material layer are provided as an intermediate layer, and hence the reliability can be improved.

In addition, according to the process for manufacturing the electron-emitting device of the present invention, the aperture or the gate electrode can be formed by removing the conductive film formed thereon, together with the removal of the mask previously selectively formed on the uncovered surface of each metal layer and cathode material. Hence, the conventional simultaneous controlling of the oblique vacuum deposition and regular vacuum deposition, which has been difficult, becomes unnecessary. The devices can therefore be readily manufactured in a good yield. Moreover the aperture and the cathode material can be readily aligned in a good accuracy.

What is claimed is:

1. An electron-emitting device comprising;

a plurality of electrically insulating substrates, each having at least an upper face, said upper face of each said substrates defining a common plane;

an intermediate layer interposed between successive substrates, said intermediate layer being recessed from said common plane;

a cathode layer material provided within said intermediate layer at a middle portion thereof and extending from said intermediate layer adjacent to said common plane; and a gate electrode provided on said upper face of each of said plurality of substrates.

2. An electron-emitting device according to claim 1, wherein said intermediate layer comprises a metal layer and an insulating material layer, and said insulating material layer and said metal layer are provided consecutively in a direction which is opposite to a direction in which said cathode layer material extends.

3. An electron-emitting device according to claim 1, wherein said intermediate layer comprises an insulating material layer.

4. An electron-emitting device according to claim 1, wherein said cathode layer material provided between said plurality of electrically insulating substrates has a wall thickness of from about 100 Å to about 1 μm.

5. An electron-emitting device according to claim 2, wherein said metal layer comprises Al or Ta.

6. An electron-emitting device according to claim 1, wherein said gate electrode comprises a material having corrosion resistance to an etchant for said intermediate layer.

7. An electron-emitting device according to claim 1, wherein said cathode layer material is selected from the group consisting of W, Mo, Ta, TiC, SiC, ZrC and $LaB_2$.

* * * * *